US008888012B2

(12) United States Patent
Cox et al.

(10) Patent No.: US 8,888,012 B2
(45) Date of Patent: Nov. 18, 2014

(54) INSULATOR FOR RAILWAY FASTENING CLIP AND RAILWAY RAIL FASTENING CLIP FOR USE THEREWITH

(75) Inventors: Stephen John Cox, Richmond (GB); Robert John Hamilton, Woking (GB); Christopher Gardner, Worksop (GB)

(73) Assignee: Pandrol Limited, Surrey (GB)

( * ) Notice: Subject to any disclaimer, the term of this patent is extended or adjusted under 35 U.S.C. 154(b) by 165 days.

(21) Appl. No.: 13/388,445

(22) PCT Filed: Aug. 13, 2010

(86) PCT No.: PCT/EP2010/061844

§ 371 (c)(1), (2), (4) Date: Apr. 6, 2012

(87) PCT Pub. No.: WO2011/020795

PCT Pub. Date: Feb. 24, 2011

(65) Prior Publication Data

US 2012/0181344 A1 Jul. 19, 2012

(30) Foreign Application Priority Data

Aug. 21, 2009 (GB) ..... 0914634.1

(51) Int. Cl.
*E01B 9/30* (2006.01)

(52) U.S. Cl.
CPC ..... *E01B 9/303* (2013.01); *E01B 2205/00* (2013.01)
USPC ..... 238/351

(58) Field of Classification Search
USPC ..... 238/351
See application file for complete search history.

(56) References Cited

U.S. PATENT DOCUMENTS 5,678,762 A * 10/1997 Wood et al. ..... 238/351
6,923,381 B2 * 8/2005 Marshall et al. ..... 238/351
7,845,578 B2 * 12/2010 Cox et al. ..... 238/349

FOREIGN PATENT DOCUMENTS

CN 200961223 Y 10/2007
CN 201265129 Y 7/2009

(Continued)

OTHER PUBLICATIONS

Great Britain's Intellectual Property Office's Search Report corresponding to Application No. GB0914634.1, dated Dec. 9, 2009.

(Continued)

*Primary Examiner* — Zachary Kuhfuss
(74) *Attorney, Agent, or Firm* — Rachel Casey; Husch Blackwell LLP

(57) ABSTRACT

An electrical insulator for use with a rail fastening clip comprises a contact member providing on one side a substantially flat rail contact surface for contacting a foot of a rail and on the opposing side a clip contact surface for contacting a rail bearing surface of a bearing portion of the clip, the insulator also having retaining means for retaining the insulator on the clip in such a way as to allow rotation of the insulator about a longitudinal axis of the bearing portion of the clip. The insulator has stop portions for limiting such rotation about the longitudinal axis of the bearing portion of the clip to a desired extent. The clip contact surface of the insulator is convex, in a vertical plane which is perpendicular to the longitudinal axis of the bearing portion of the clip, such that, when the insulator is attached to a clip having a flat rail bearing surface, a contact region between the flat rail bearing surface of the clip and the clip contact surface of the insulator is linear. The insulator is rockable about the linear contact region within the extent defined by the stop portions such that, when the rail contact surface of the insulator contacts the surface of a rail foot, the angle of the rail contact surface can conform to the angle of the rail foot surface. A rail fastening clip, suitable for use with the insulator and of the kind driven onto a rail in a direction which is parallel to a longitudinal axis of the rail, has a bearing portion having a flat rail bearing surface, wherein a detent, extending laterally with respect to the longitudinal axis of the bearing portion, is formed in the flat rail bearing surface, at a location spaced from a free end of the bearing portion of the clip, for engaging a corresponding abutment surface of the insulator to be retained on the rail bearing portion of the clip.

23 Claims, 7 Drawing Sheets

(56) References Cited

FOREIGN PATENT DOCUMENTS

| | | | | | |
|---|---|---|---|---|---|
| DE | 198 01 584 | A1 | | 7/1999 | |
| EP | 0 388 190 | A1 | | 9/1990 | |
| GB | 838860 | | | 6/1960 | |
| GB | 2074638 | A | * | 11/1981 | ..... E01B 9/30 |
| GB | 2 295 178 | A | | 5/1996 | |
| WO | WO 93/12294 | | | 6/1993 | |
| WO | WO 97/36055 | A1 | | 10/1997 | |
| WO | WO 02/31264 | A1 | | 4/2002 | |
| WO | WO 2007/096616 | | | 8/2007 | |

OTHER PUBLICATIONS

English translation of abstract of CN200961223 (Y).

English translation of abstract CN201265129 (Y).

International Search Report, Intl. Application No. PCT/EP2010/061844 (Intl. Publ. No. WO 2011/020795 A1), search report dated Dec. 8, 2010.

International Search Report, Intl. Application No. PCT/EP 2010/061843 (Intl. Publ. No. WO 2011/020794 A1), search report dated Jan. 17, 2011.

* cited by examiner

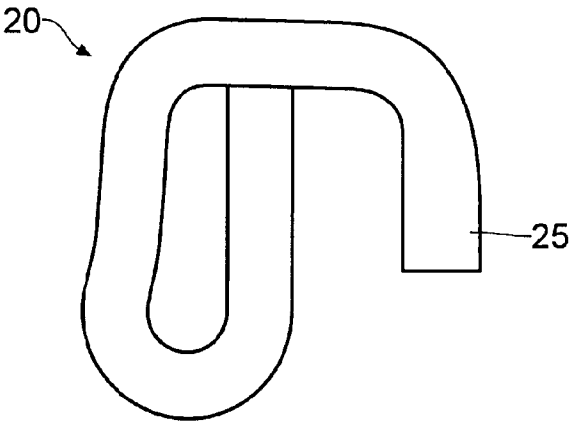
FIG. 4A
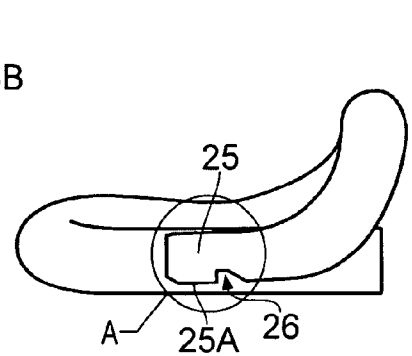
FIG. 4B
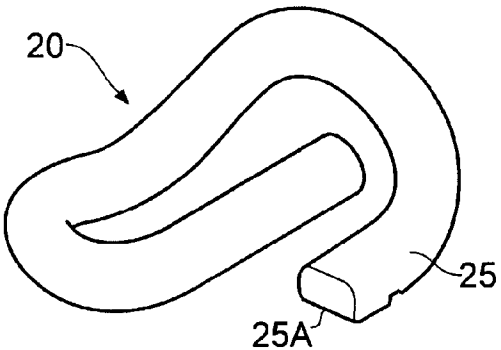
FIG. 4C
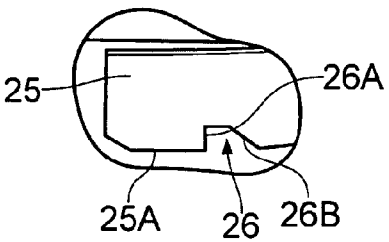
FIG. 4E
FIG. 4D

INSULATOR FOR RAILWAY FASTENING CLIP AND RAILWAY RAIL FASTENING CLIP FOR USE THEREWITH

The present invention relates to an insulator for a railway rail fastening clip and a railway rail fastening clip for use therewith.

FIG. 1 of the accompanying drawings shows a prior art rail fastening assembly as disclosed in WO 97/36055. In WO 97/36055 the applicant proposed an electrical insulator 100 for use with a railway rail fastening clip 200 of the type having a first portion 201 for engaging a passageway 401 in a clip anchoring device 400, a bent second portion 202, a third portion 203 which bears on another part of the anchoring device 400, a bent fourth portion 204, and a fifth portion 205 which, when the clip 200 is in use, bears on the foot 31 of a rail 30 and extends in a direction substantially parallel to the longitudinal axis of that rail 30. In WO 97/36055 the disclosed insulator 100 is carried on the fifth, hereafter called "toe", portion 305 of the clip 200 such that, once applied to the clip 200, it is retained on the clip toe 205 during installation and removal of the clip 200 onto and from the rail 30. The insulator 100 of WO 97/36055 is designed to rotate about the longitudinal axis of the toe portion 205 of the clip 200, so as to self-align to the angle of the rail foot 31, and also to separate the clip toe from dynamic rail movements.

According to an embodiment of a first aspect of the present invention there is provided an electrical insulator for use with a railway rail fastening clip, the insulator comprising a contact member providing on one side a rail contact surface for contacting a foot of a railway rail and on the opposing side a clip contact surface for contacting a rail bearing surface of a bearing portion of the clip, the insulator also having retaining means for retaining the insulator on the clip in such a way as to allow rotation of the insulator about a longitudinal axis of the bearing portion of the clip, wherein the insulator has stop portions for limiting such rotation of the insulator about the longitudinal axis of the bearing portion of the clip to a desired extent, and wherein the rail contact surface of the insulator is substantially flat and the clip contact surface of the insulator is convex, in a vertical plane which is perpendicular to the longitudinal axis of the bearing portion of the clip, such that, when the insulator is attached to a clip having a flat rail bearing surface, a contact region between the flat rail bearing surface of the clip and the clip contact surface of the insulator is linear, and wherein the insulator is rockable about the linear contact region within the extent defined by the stop portions such that, when the rail contact surface of the insulator contacts the surface of a rail foot, the angle of the rail contact surface can conform to the angle of the rail foot surface.

In this specification the "rail bearing surface" of the clip is that surface of the clip through which load is applied to a railway rail via the electrical insulator.

An insulator embodying the first aspect of the present invention can provide a more robust and reliable connection between the insulator and the clip with which it is used, and is easier to produce and fit reliably, than an insulator such as disclosed in WO 97/36055. Although it does not rotate freely about the toe portion of the clip, unlike that of WO 97/36055, it rocks so as to conform to the rail foot angle over a desired angular range when installed in a rail fastening assembly, so there is no need to provide different versions of the insulator for slightly different assemblies.

The insulator may further comprise side members extending from the contact member of the insulator on opposite sides thereof in a direction which is substantially parallel to the longitudinal axis of the bearing portion of the clip. Internal walls of the side members may serve as the stop portions of the insulator.

The retaining means may include a retention member connected to and extending between the side members. Parts of an internal wall of the retention member may serve as the or additional stop portions.

The retaining means may be adapted to prevent unintended movement of the insulator in a direction parallel to the longitudinal axis of the bearing portion of the clip. The retaining means desirably comprise an abutment surface provided on the clip contact surface for engaging a corresponding detent in the rail bearing surface of the clip, which detent extends laterally with respect to the longitudinal axis of the bearing portion of the clip. The abutment surface is preferably provided by a side of a ridge formed on the clip contact surface. Respective sides of the ridge may form first and second abutment surfaces, the first abutment surface being steeper than the second abutment surface and being adapted to resist unintentional removal of the insulator from a clip.

The top of the ridge may be convex in a vertical plane which is perpendicular to the longitudinal axis of the bearing portion of the clip. The ridge may extend from one side member to the other.

The insulator is desirably of generally rectangular external cross-section in a vertical plane perpendicular to the longitudinal axis of the bearing portion of the clip, except possibly for chamfering at the corners. Thus, in contrast to the rounded profile of the above-discussed prior art insulator, which can cause handling and orientation problems with automated equipment, the insulator can be used much more easily by machines for applying the insulator to a clip toe.

The insulator desirably has substantially flat exterior faces, except possibly on an exterior face of the retaining member.

The rail contact surface may have a chamfer at at least one end thereof for assisting in driving of a clip carrying the insulator onto a rail. Preferably, both ends of the rail contact surface have a chamfer for assisting in driving or removing a clip carrying the insulator onto or from a rail.

At least one of the side members may not extend at full height along the entire length of the contact member.

The retention member may not extend along the entire length of the side members.

The contact member, side members and retention member may be considered to form an insulator cavity and one end of the insulator may be provided with an abutment member for preventing overdriving of a clip into the insulator cavity.

The insulator may further comprise a fin, extending along an inner face of that one of the side members which is to be closest to an edge of the rail foot when the insulator is in use, for contacting the clip so as to inhibit skewing of the insulator on the bearing portion of the clip.

According to an embodiment of a second aspect of the present invention, there is provided a railway rail fastening clip configured to be driven onto a railway rail in a direction which is substantially parallel to a longitudinal axis of the rail, which clip has a bearing portion having a flat rail bearing surface, wherein a detent, extending laterally with respect to the longitudinal axis of the bearing portion, is formed in the flat rail bearing surface, at a location spaced from a free end of the bearing portion of the clip, for engaging a corresponding abutment surface of an electrical insulator to be retained on the rail bearing portion of the clip.

The detent may be shaped so as to provide first and second abutment surfaces, the first abutment surface being steeper than the second abutment surface and being adapted to resist unintentional removal of an electrical insulator on the bearing portion from the clip. The detent may be formed only on the flat rail bearing surface and may not extend up to or across the top of the bearing portion of the clip.

A railway rail fastening clip embodying the second aspect of the present invention may be used in combination with an electrical insulator embodying the first aspect of the present invention.

Reference will now be made, by way of example, to the accompanying drawings, in which.

Figure 1B:
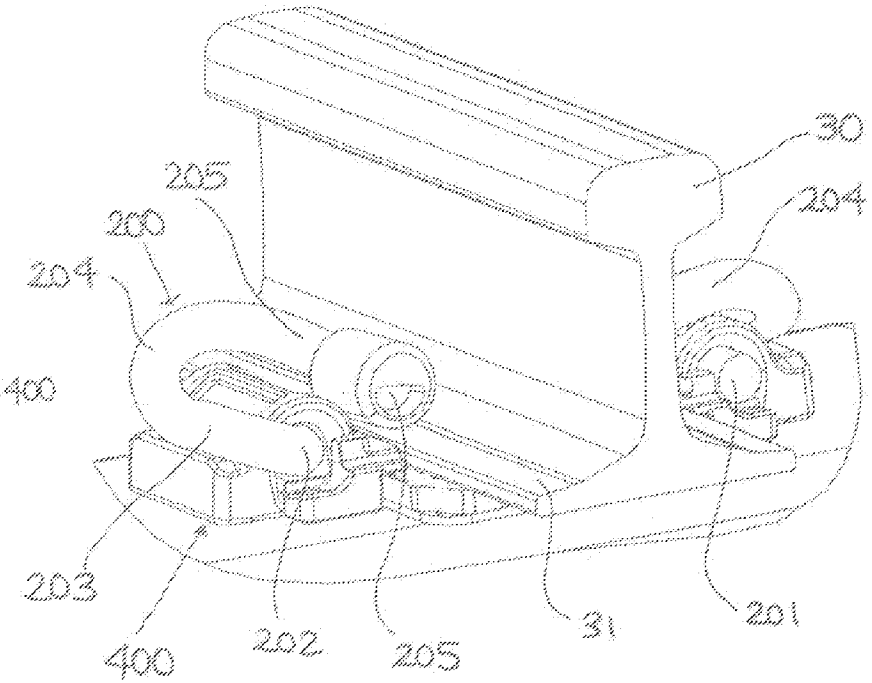
FIG. 1B Prior Art
FIG. 1 (described above) shows a prior art railway rail fastening assembly.
Figure 1A:
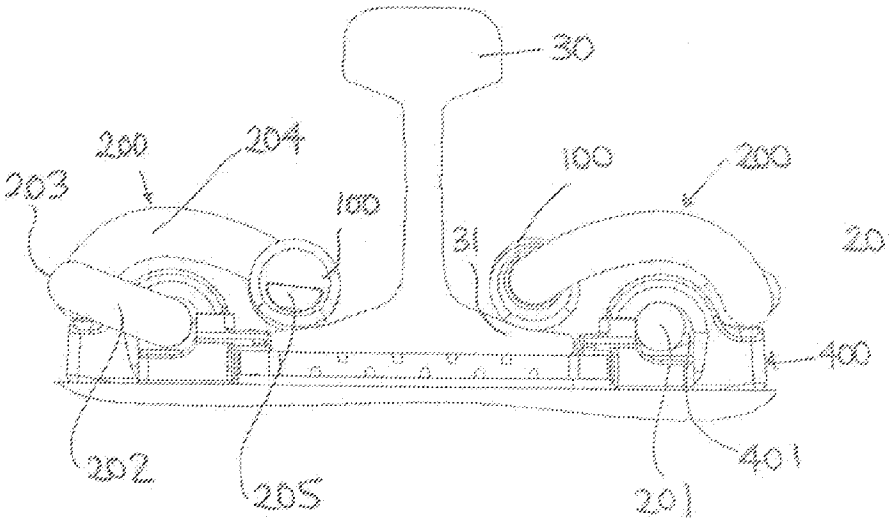
FIG. 1A Prior Art
Figure 2:
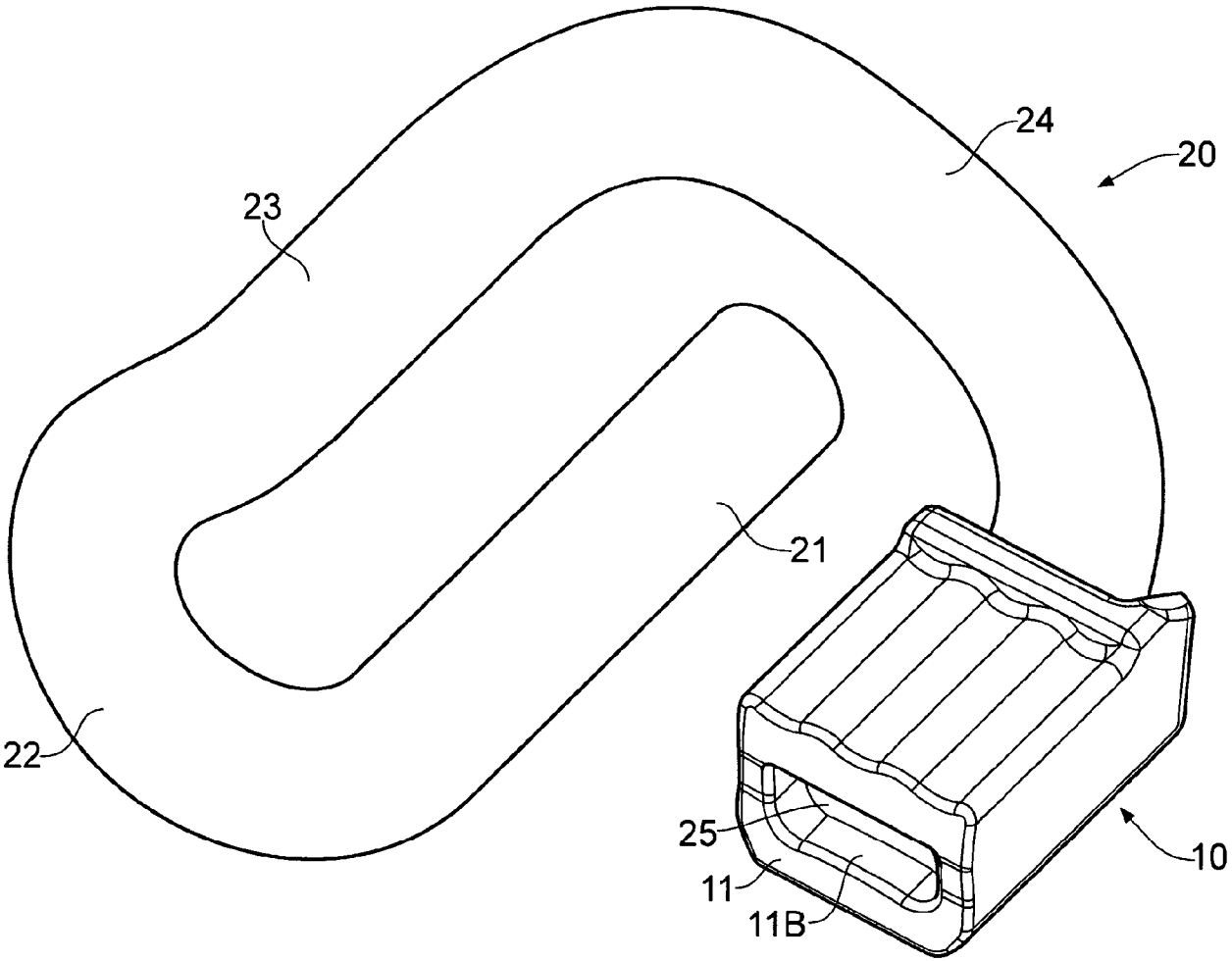
FIG. 2 shows a perspective view of an electrical insulator embodying the first aspect of the present invention carried by a railway rail fastening clip embodying a second aspect of the present invention.
Figure 3B:
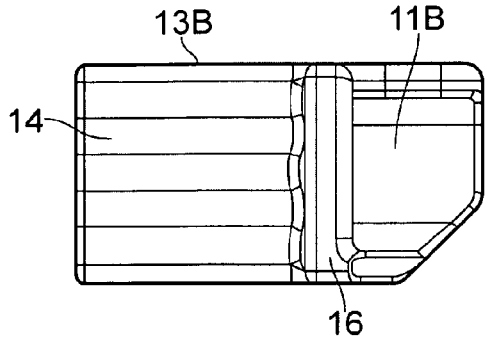
Figure 3A:
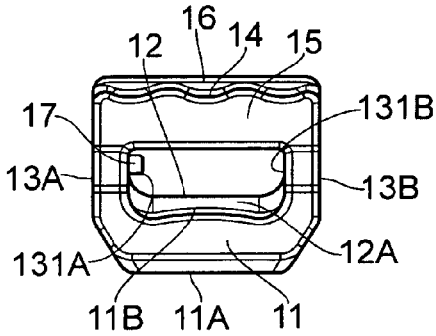
Figure 3C:
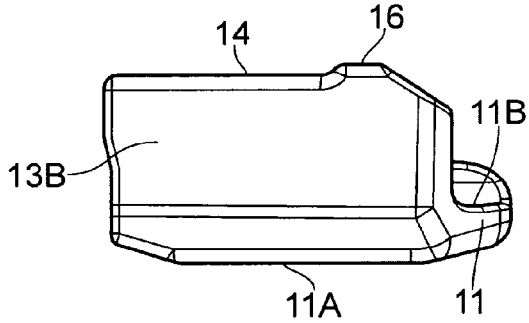
Figure 3D:
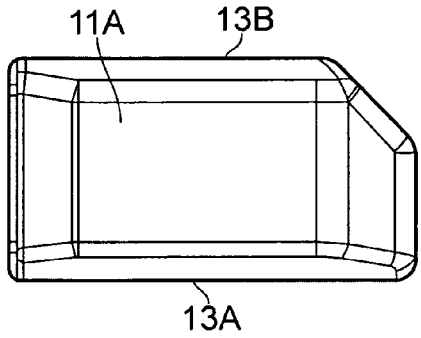
Figure 3I:
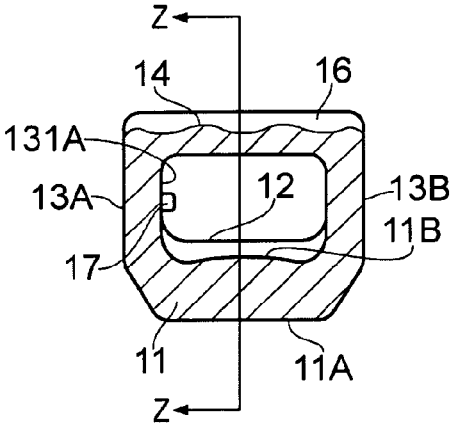
Figure 3J:
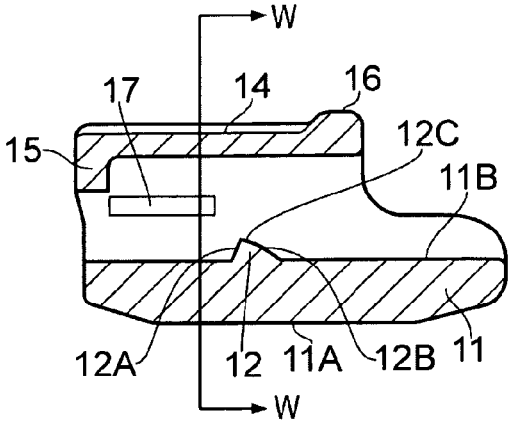
Figure 3E:
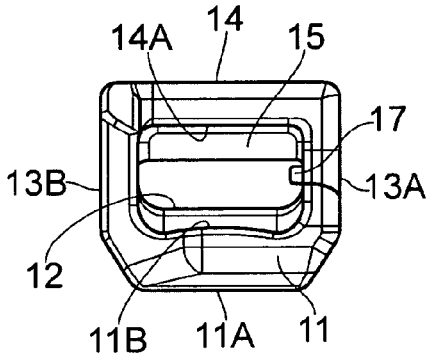
Figure 3F:
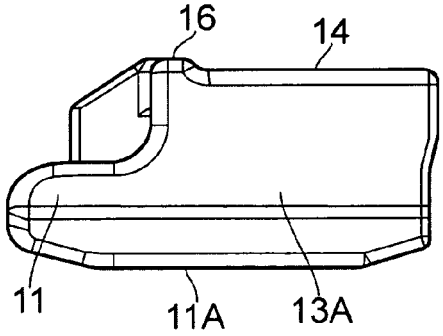
Figure 3G:
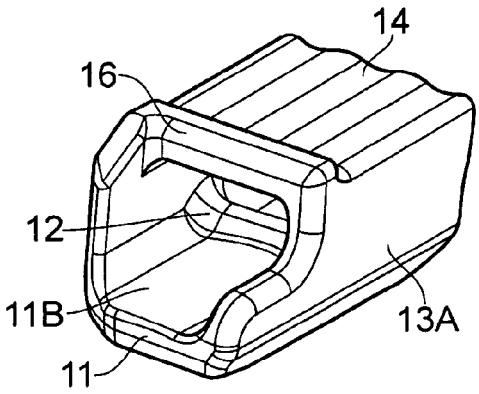
Figure 3H:
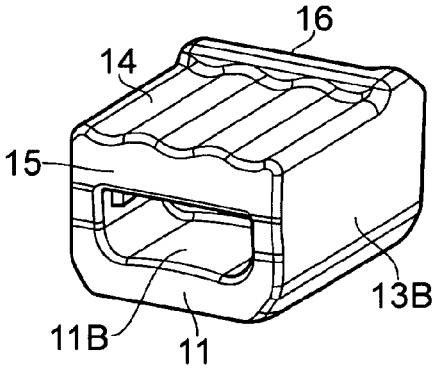
Figure 5B:
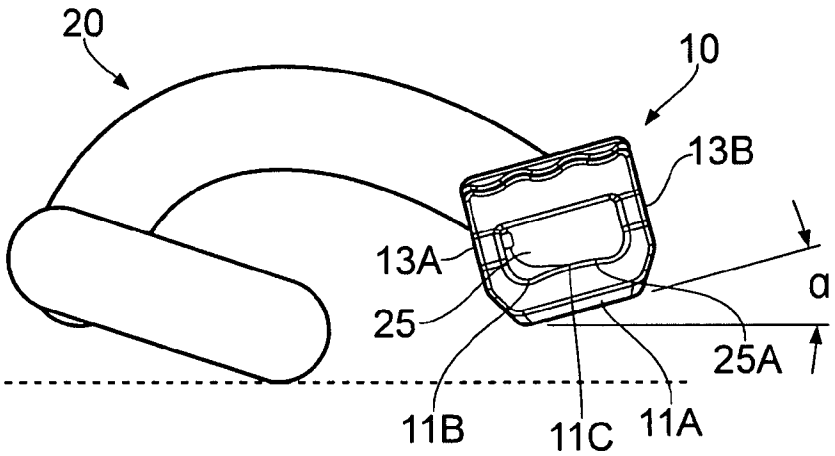
Figure 5A:
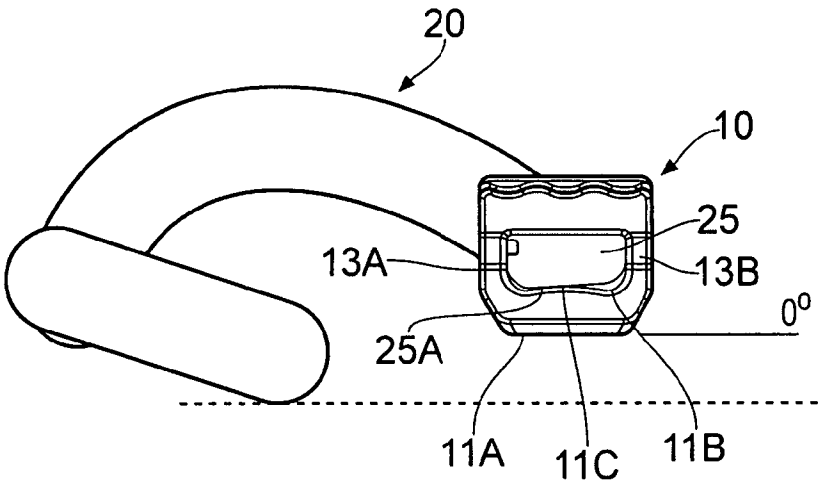
Figure 6:
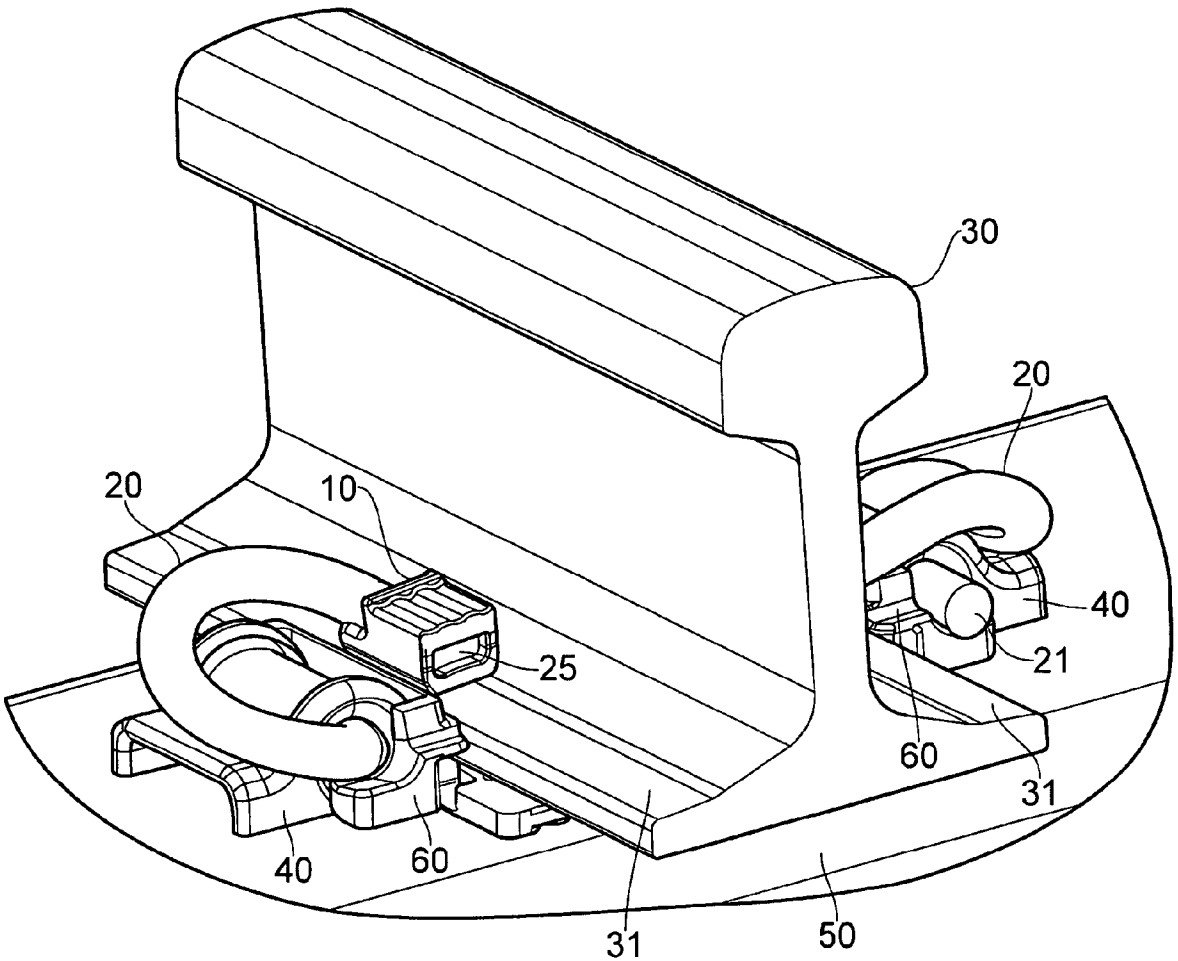

FIG. 3 shows an electrical insulator embodying a first aspect of the present invention, FIG. 3A showing a first end view, FIG. 3B showing a view from above, FIG. 3C showing a view from one side, FIG. 3D showing a view from below, FIG. 3E showing a view from the opposite end, FIG. 3F showing a view from the opposite side, FIG. 3G showing a first perspective view, FIG. 3H showing a second perspective view, FIG. 3I showing a cross-sectional view taken on the line W-W in FIG. 3J, and FIG. 3J showing a cross-sectional view taken on the line Z-Z in FIG. 3I;

FIG. 4 shows views of a railway rail fastening clip embodying the second aspect of the present invention, in which FIG. 4A shows a view from above, FIG. 4B shows an end view, FIG. 4C shows a perspective view, FIG. 4D shows a side view and FIG. 4E shows an enlarged view of detail A shown in FIG. 4D;

FIGS. 5A and 5B show an insulator embodying the first aspect of the present invention located on a clip embodying the second aspect of the present invention, in two configurations; and FIG. 6 shows a perspective view of a railway rail fastening assembly incorporating railway rail fastening clips and electrical insulators embodying the present invention.

As shown in the Figures, an electrical insulator embodying the first aspect of the present invention comprises a contact member 11 providing on one side thereof a rail contact surface 11A for contacting a foot 31 of a railway rail 30 and on the opposing side a clip contact surface 11B for contacting a rail bearing surface 25A of a bearing portion 25 of a railway rail fastening clip 20. A ridge 12 is provided on the clip contact surface 11B of the contact member 11. The insulator 10 is retained on the clip 20 in such a way as to allow rotation of the insulator 10 about a longitudinal axis of the bearing portion 25 of the clip 20. Side members 13A, 13B project upwardly from the contact member 11 on opposite sides thereof in a direction which is substantially parallel to the longitudinal axis of the bearing portion 25 of the clip 20. In this embodiment, respective internal walls 131A, 131B of the side members 13A, 13C form stop portions which limit rotation of the insulator about the longitudinal axis of the bearing portion of the clip to a desired extent, typically an angular rotational range $\alpha$ of only about 15° from one stop portion to the other to accommodate a rail foot with a slope of up to 1 in 4. At the opposite ends of the side members 13A, 13B to those connected to the contact member 11 the side members 13A, 13B are connected to a retention member 14 which extends between them. Parts of an internal wall 14A of the retention member 14 serve as stop portions for limiting rotation of the insulator 10 about the longitudinal axis of the bearing portion 25 of the clip 20. In this embodiment, the contact member 11, ridge 12, side members 13A, 13B and retention member 14 together serve as retaining means for retaining the insulator 10 on the clip 20 in such a way as to allow rotation of the insulator about the longitudinal axis of the bearing portion 25 of the clip 20, but in other embodiments this could be achieved in other ways.

Thus, the contact member 11, side members 13A and 13B, and retention member 14 form an insulator cavity. Extending downwardly from one end of the retention member 14, which is that end which will be adjacent to the free end of the bearing portion 25 of the clip 20, the insulator 10 is provided with an abutment member 15 which serves to prevent overdriving of the bearing portion 25 of the clip into the insulator cavity.

The insulator 10 will be subject to high loads when being installed on the toe of a clip 20, and when the combined clip and insulator is being installed in, or extracted from, a rail fastening assembly, so for added strength the insulator 10 in this embodiment has a bar 16 of additional material provided across the top of one end of the retention member 14.

The insulator 10 has an external cross-section in a vertical plane perpendicular to the longitudinal axis of the bearing portion 25 of the clip 20 which is substantially rectangular, although some corners may be chamfered as shown in FIG. 3A for example. The shape of the exterior of the insulator 10 makes it easier to handle and orientate with automated equipment, as compared to the prior art insulator. The external shape of the insulator 10 also makes it comparatively easy to mould as it can be split front to back. The side members 13A, 13B, preferably have substantially flat external surfaces. The retention member 14 may have a substantially flat external surface, but in this embodiment is provided with a ribbed surface.

The rail contact surface 11A of the contact member 11 is flat, whereas the clip contact surface 11B of the contact member 11 is convex in a vertical plane which is perpendicular to the longitudinal axis of the bearing portion 25 of the clip 20. When the insulator 10 is attached to a clip 20 having a flat rail bearing surface 25A, a contact region 11C between the flat rail bearing surface 25A of the clip and the clip contact surface 11B of the insulator 10 is linear. As shown in FIGS. 5A and 5B, the insulator 10 is rockable about the linear contact region 11C within the extent defined by the stop portions such that, when the rail contact surface 11A of the insulator 11 contacts the upper surface of a rail foot 31, the angle of the rail contact surface 11A can conform to the angle of the rail foot surface. This allows the same clip and insulator combination to be used in many different rail fastening assemblies. In contrast, rail clips such as the Pandrol e-clip® are made in many different designs in which the angle of the flat rail bearing surface varies from version to version in accordance with the angle of the rail foot with which the clip is to be used.

In order to inhibit displacement of the insulator 10 from the bearing portion 25 once it has been applied thereto the flat rail bearing surface 25A of the bearing portion 25 of the clip 20 is provided with a detent 26 having a first abutment surface 26A for engaging a corresponding abutment surface 12A on the insulator 10 and a second abutment surface 26B which is less steep than the first abutment surface 26A. The corresponding abutment surface 12A on the insulator 10 is provided by a side face 12A of the ridge 12 formed on the clip contact surface 11B of the contact member 11. The opposite side surface 12B of the ridge 12 provides a second abutment face which is less steep than the first abutment face 12A. A top surface 12C of the ridge 12 is substantially flat in the embodiment illustrated, but may be convex in a vertical plane extending perpendicularly to the longitudinal axis of the bearing portion 25 of the clip 20, if the depth of the detent 26 in the clip 20 with which the insulator 10 is to be used is such that the ridge 12 touches the flat bottom of the detent 26. In the embodiment shown the detent 26 is formed only on the flat rail bearing surface 25A on the underside of the bearing portion 25 of the clip 2 and does not extend up to or across the top of the bearing portion 25, but a detent which also extends up to and/or across the top of the bearing portion 25 may be employed in some embodiments.

FIG. 6 shows a rail fastening assembly incorporating two clips 20 embodying the second aspect of the invention each carrying on the bearing portion 25 of the clip 20 an insulator 10 embodying the first aspect of the present invention, the clips 20 having portions 21 which are installed in respective clip anchoring devices 40, secured to a rail foundation 50, such that the bearing portions 25 of the clips 20 apply load through the insulators 10 to a foot 31 of a railway rail 30. Each insulator 10 has rocked about its linear contact region with the clip bearing portion 25 so as to confoxm to the angle of the rail foot surface. On each side of the rail 30, between its foot 31 and the adjacent anchoring device 40, sidepost insulators 60 are provided to electrically insulate the anchoring devices 40 from the rail 30.

As the clip 20 and insulator 10 are installed in a rail fastening assembly there may be a tendency for the insulator 10 to rotate on the bearing portion 25 of the clip 20 about a vertical axis, such that the longitudinal axis of the insulator 10 is skewed with respect to the rail axis. In this position the insulator 10 may overhang the edge of the rail, which is disadvantageous as the insulator may catch on the sidepost insulator 60 and be tipped up, which could lead to the insulator 10 wearing more quickly or to fatigue of the clip 20. In order to inhibit this tendency for the insulator 10 to skew, the internal wall 131A of the side member 13A, which is closest to the rail foot edge when the clip 20 and insulator 10 are in use, is provided with an edge fin 17 for contacting the side of the bearing portion 25.

The side members 13A, 13B do not extend at full height along the entire length of the contact member 11 and the retention member 14 does not extend along the full length of the side members 13A, 13B. In this respect, one corner of one end of the side member 13A is cut away with respect to the corresponding corner of the side member 13B so as not to interfere with the clip 20. Material is also saved by cutting off part of the contact member 11 and side member 13B where the bearing portion 25 of the clip 20 starts to bend up and away from the insulator 10.

The invention claimed is:

1. An electrical insulator for use with a railway rail fastening clip, the insulator comprising a contact member providing on one side a rail contact surface for contacting a foot of a railway rail and on the opposing side a clip contact surface for contacting a rail bearing surface of a bearing portion of the clip, the insulator also having retaining means for retaining the insulator on the clip in such a way as to allow rotation of the insulator about a longitudinal axis of the bearing portion of the clip, wherein the insulator has stop portions for limiting such rotation of the insulator about the longitudinal axis of the bearing portion of the clip to a desired extent, and wherein the rail contact surface of the insulator is substantially flat and the clip contact surface of the insulator is convex, in a vertical plane which is perpendicular to the longitudinal axis of the bearing portion of the clip, such that, when the insulator is attached to a clip having a flat rail bearing surface, a contact region between the flat rail bearing surface of the clip and the clip contact surface of the insulator is linear, and wherein the insulator is rockable about the linear contact region within the extent defined by the stop portions such that, when the rail contact surface of the insulator contacts the surface of a rail foot, the angle of the rail contact surface can conform to the angle of the rail foot surface.

2. An insulator as claimed in claim 1, further comprising side members extending from the contact member of the insulator on opposite sides thereof in a direction which is substantially parallel to the longitudinal axis of the bearing portion of the clip.

3. An insulator as claimed in claim 2, wherein internal walls of the side members serve as the stop portions of the insulator.

4. An insulator as claimed in claim 2, wherein the retaining means include a retention member connected to and extending between the side members.

5. An insulator as claimed in claim 4, wherein parts of an internal wall of the retention member serve as the stop portions.

6. An insulator as claimed in claim 4, wherein internal walls of the side members serve as the stop portions of the insulator and parts of an internal wall of the retention member serve as additional such stop portions.

7. An insulator as claimed in claim 4, wherein the retention member does not extend along the entire length of the side members.

8. An insulator as claimed in claim 4, wherein the contact member, side members and retention member form an insulator cavity and wherein one end of the insulator is provided with an abutment member for preventing overdriving of a clip into the insulator cavity.

9. An insulator as claimed in claim 2, wherein at least one of the side members does not extend at full height along the entire length of the contact member.

10. An insulator as claimed in claim 1, wherein the retaining means are adapted to prevent unintended movement of the insulator in a direction parallel to the longitudinal axis of the bearing portion of the clip.

11. An insulator as claimed in claim 10, wherein the retaining means include an abutment surface provided on the clip contact surface for engaging a corresponding detent in the rail bearing surface of the clip, which detent extends laterally with respect to the longitudinal axis of the bearing portion of the clip.

12. An insulator as claimed in claim 11, wherein the abutment surface is provided by a side of a ridge formed on the clip contact surface.

13. An insulator as claimed in claim 12, wherein respective sides of the ridge form first and second abutment surfaces, the first abutment surface being steeper than the second abutment surface and being adapted to resist unintentional removal of the insulator from a clip.

14. An insulator as claimed in claim 12, wherein the top of the ridge is convex in a vertical plane which is perpendicular to the longitudinal axis of the bearing portion of the clip.

15. An insulator as claimed in claim 12, further comprising side members extending from the contact member of the insulator on opposite sides thereof in a direction which is substantially parallel to the longitudinal axis of the bearing portion of the clip, wherein the ridge extends from one side member to the other.

16. An insulator as claimed in claim 1, wherein the insulator is of generally rectangular external cross-section in a vertical plane perpendicular to the longitudinal axis of the bearing portion of the clip.

17. An insulator as claimed in claim 1 having substantially flat exterior faces.

18. An insulator as claimed in claim 1, wherein the rail contact surface has a chamfer at least one end thereof for assisting in driving of a clip carrying the insulator onto a rail.

19. An insulator as claimed in claim 18, wherein both ends of the rail contact surface have a chamfer for assisting in driving or removing a clip carrying the insulator onto or from a rail.

20. An insulator as claimed in claim 1, further comprising a fin, extending along an inner face of that one of the side members which is to be closest to an edge of the rail foot when the insulator is in use, for contacting the clip so as to inhibit skewing of the insulator on the bearing portion of the clip.

21. An apparatus comprising the elelctrical insulator of claim 1 and a railway rail fastening clip, configured to be driven onto a railway rail in a direction which is substantially parallel to a longitudinal axis of the rail, which clip has a bearing portion having a flat rail bearing surface, the insulator being located on the bearing portion of the clip such that the clip contact surface of the insulator contacts the rail bearing surface of the bearing portion of the clip, wherein the retaining means of the insulator include an abutment surface provided on the slip contact surface and the clip a detent, extending laterally with respect to the longitudinal axis of the bearing portion of the clip and formed in the flat rail bearing surface, at a location spaced from a free end of the bearing portion of the clip, for engaging the abutment surface of the insulator, the detent of the clip being shaped so as to provide first and second abutment surfaces, the first abutment surface being steeper than the second abutment surface and being adapted to resist unintentional removal of the insulator from the bearing portion from the clip.

22. The apparatus as claimed in claim 21, wherein the detent of the clip is formed only on the flat rail bearing surface and does not extend up to or across the top of the bearing portion of the clip.

23. An electrical insulator for use with a railway rail fastening clip, the insulator comprising a contact member providing on one side a rail contact surface for contacting a foot of a railway rail and on the opposing side a clip contact surface for contacting a rail bearing surface of a bearing portion of the clip, the insulator also having a retainer that retains the insulator on the clip for rotation of the insulator about a longitudinal axis of the bearing portion of the clip, including at least one stop that limits rotation of the insulator about the longitudinal axis of the bearing portion of the clip to a selected extent, and wherein the rail contact surface of the insulator is substantially flat and the clip contact surface of the insulator is convex, in a vertical plane which is perpendicular to the longitudinal axis of the bearing portion of the clip, wherein when the insulator is attached to a clip having a flat rail bearing surface, a contact region between the flat rail bearing surface of the clip and the clip contact surface of the insulator is linear, and wherein the insulator is rockable about the linear contact region within the extent defined by the at least one stop such that, when the rail contact surface of the insulator contacts a selected surface, the angle of the rail contact surface can conform to an angle of the rail foot surface.

* * * * *